US005945912A

United States Patent [19]

Guldbrand

[11] Patent Number: 5,945,912

[45] Date of Patent: Aug. 31, 1999

[54] OCEAN SAFE

[76] Inventor: Tony Guldbrand, 757 SE 17th St. Suite 353, Ft. Lauderdale, Fla. 33316

[21] Appl. No.: 09/057,776

[22] Filed: Apr. 9, 1998

[51] Int. Cl.[6] ..... G08B 23/00

[52] U.S. Cl. ..... 340/573.1; 340/573.6; 340/539; 116/210; 116/DIG. 9

[58] Field of Search ..... 340/573.1, 573.6, 340/539, 815.15; 116/210, DIG. 9, DIG. 8; 206/573, 223, 803

[56] References Cited

U.S. PATENT DOCUMENTS

| | | | |
|---|---|---|---|
| 4,079,364 | 3/1978 | Antenore | 340/573 |
| 4,101,894 | 7/1978 | Warner et al. | 343/112 R |
| 4,295,438 | 10/1981 | Porter | 116/210 |
| 4,305,143 | 12/1981 | Simms et al. | 340/573 |
| 4,523,913 | 6/1985 | Kaino | 441/81 |
| 4,549,169 | 10/1985 | Moura et al. | 340/573 |
| 4,586,456 | 5/1986 | Forward | 116/210 |
| 4,714,914 | 12/1987 | Boe | 340/573 |
| 4,959,637 | 9/1990 | Woods et al. | 340/573 |
| 5,021,765 | 6/1991 | Morgan | 340/573 |
| 5,262,768 | 11/1993 | Florer | 340/473 |
| 5,274,359 | 12/1993 | Adams | 340/573 |
| 5,408,222 | 4/1995 | Yaffe et al. | 340/573 |
| 5,429,244 | 7/1995 | McCreary | 116/210 |
| 5,619,187 | 4/1997 | Serfontein | 340/573 |

*Primary Examiner*—Nina Tong

[57] ABSTRACT

A rescue system is provided including a transmitter housing and a recovery assembly including a transmitter situated within an interior space of the transmitter housing. The transmitter is adapted for emitting an emergency signal via free space upon the actuation thereof. Also included is a moisture sensor situated on the transmitter housing and connected to the transmitter for actuating the same during the detection of a predetermined amount of moisture. A receiver unit includes a direction sensor for indicating a direction of the transmitter housing upon the receipt of the emergency signal via free space.

12 Claims, 4 Drawing Sheets

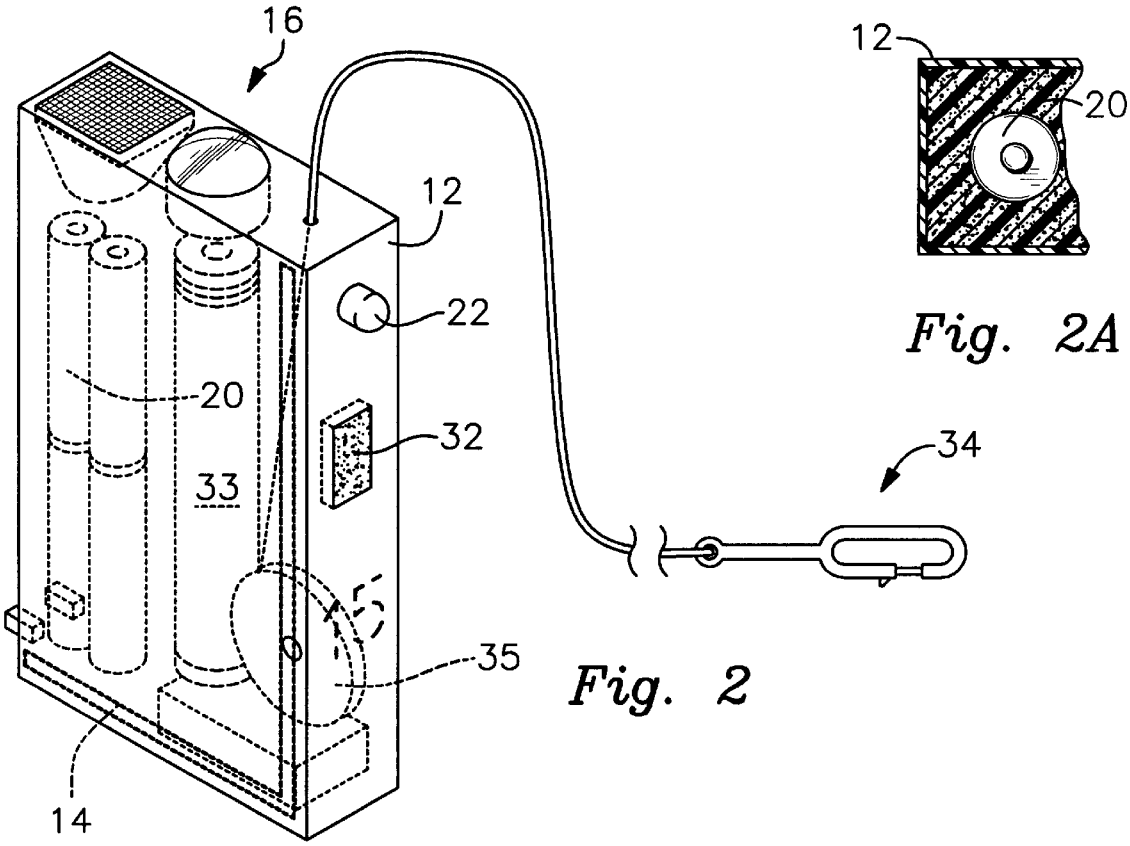
Fig. 2
Fig. 2A
Fig. 3
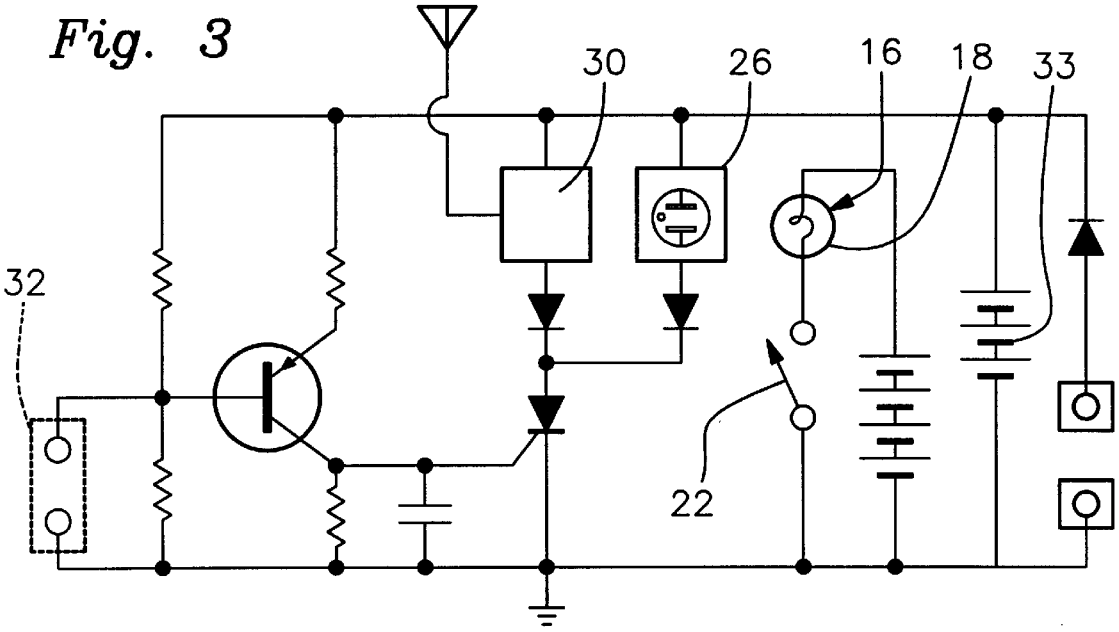

OCEAN SAFE

BACKGROUND OF THE INVENTION

1. Field of the Invention

The present invention relates to distress signaling devices and more particularly pertains to a new rescue apparatus for rescuing a person or pet who falls overboard.

2. Description of the Prior Art

The use of distress signaling devices is known in the prior art. More specifically, distress signaling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art distress signaling devices include U.S. Pat. No. 4,295,438; U.S. Pat. No. 5,262,768; U.S. Pat. No. 4,101,894; U.S. Pat. No. 4,586,456; U.S. Pat. No. 5,429,244; and U.S. Pat. No. 4,523,913.

In these respects, the rescue apparatus according to the present invention substantially departs from the conventional concepts and designs of the prior art, and in so doing provides an apparatus primarily developed for the purpose of rescuing a person or pet who falls overboard.

SUMMARY OF THE INVENTION

In view of the foregoing disadvantages inherent in the known types of distress signaling devices now present in the prior art, the present invention provides a new rescue apparatus construction wherein the same can be utilized for rescuing a person or pet who falls overboard.

The general purpose of the present invention, which will be described subsequently in greater detail, is to provide a new rescue apparatus and method which has many of the advantages of the distress signaling devices mentioned heretofore and many novel features that result in a new rescue apparatus which is not anticipated, rendered obvious, suggested, or even implied by any of the prior art distress signaling devices, either alone or in any combination thereof.

To attain this, the present invention generally comprises a transmitter housing having a rectangular configuration. The transmitter housing includes a front face, a rear face and a thin periphery formed therebetween defining an interior space. The front face has a mirror mounted thereon for distress signaling purposes. During use, the transmitter housing is adapted to float in water. Also included is a flashlight assembly having an illumination lamp mounted on a first side face of the periphery of the transmitter housing. As shown in FIG. 2, a plurality of replaceable batteries are situated within the interior space of the transmitter housing. Connected between the illumination lamp and the replaceable batteries is a manual switch mounted on a second side face of the periphery adjacent to the first side face of the transmitter housing. During use, the manual switch functions for allowing the selective use of the transmitter housing as a flashlight. Next provided is a recovery assembly including a strobe light mounted on the transmitter housing. The strobe light serves for emitting a high intensity intermittent light upon the actuation thereof. A transmitter is mounted within the interior space of the transmitter housing for emitting an emergency signal via free space upon the actuation thereof. For actuating the strobe light and transmitter during the detection of a predetermined amount of moisture, a moisture sensor is situated on the periphery of the housing. FIG. 2 shows a coupling unit including a spring loaded spool positioned within the interior space of the transmitter housing. A first end of a cord is coupled to the spool. Such cord further has a second end extending from an aperture formed in the first side face of the periphery of the housing with a clip formed thereon for coupling to a user. In operation, the cord is automatically retractable. Finally, a receiver unit is provided including a receiver housing with a rear face having a pair of mounting wall apertures for mounting on a boat. Mounted on a front face of the receiver housing is a strobe for emitting a high intensity intermittent light upon the receipt of the emergency via free space. FIG. 5 depicts a direction sensor including a plurality of lights mounted on the receiver housing in a circular configuration. In use, the lights of the direction sensor are adapted for indicating a direction of the transmitter housing upon the receipt of the emergency signal via free space. It should be noted that the receiver unit, upon the receipt of the emergency signal via free space, is adapted to kill an engine of the boat, lower the sails on a sailboat, release a ladder of the boat into the water, release a life ring of the boat into the water, and actuate an audio alarm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rescue apparatus and method which has many of the advantages of the distress signaling devices mentioned heretofore and many novel features that result in a new rescue apparatus which is not anticipated, rendered obvious, suggested, or even implied by any of the prior art distress signaling devices, either alone or in any combination thereof.

It is another object of the present invention to provide a new rescue apparatus which may be easily and efficiently manufactured and marketed.

It is a further object of the present invention to provide a new rescue apparatus which is of a durable and reliable construction.

An even further object of the present invention is to provide a new rescue apparatus which is susceptible of a low cost of manufacture with regard to both materials and labor, and which accordingly is then susceptible of low prices of sale to the consuming public, thereby making such rescue apparatus economically available to the buying public.

Still yet another object of the present invention is to provide a new rescue apparatus which provides in the apparatuses and methods of the prior art some of the advantages thereof, while simultaneously overcoming some of the disadvantages normally associated therewith.

Still another object of the present invention is to provide a new rescue apparatus for rescuing a person or pet who falls overboard.

Even still another object of the present invention is to provide a new rescue apparatus that includes a transmitter housing and a recovery assembly including a transmitter situated within an interior space of the transmitter housing. The transmitter is adapted for emitting an emergency signal via free space upon the actuation thereof. Also included is a moisture sensor situated on the transmitter housing and connected to the transmitter for actuating the same during the detection of a predetermined amount of moisture. A receiver unit includes a direction sensor for indicating a direction of the transmitter housing upon the receipt of the emergency signal via free space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the transmitter housing of the present invention.

FIG. 2A is a cross-sectional view of the transmitter housing of the present invention showing the battery thereof.

FIG. 3 is a schematic diagram of the circuitry associated with the transmitter housing of the present invention.

DESCRIPTION OF THE PREFERRED EMBODIMENT

Figure 1:
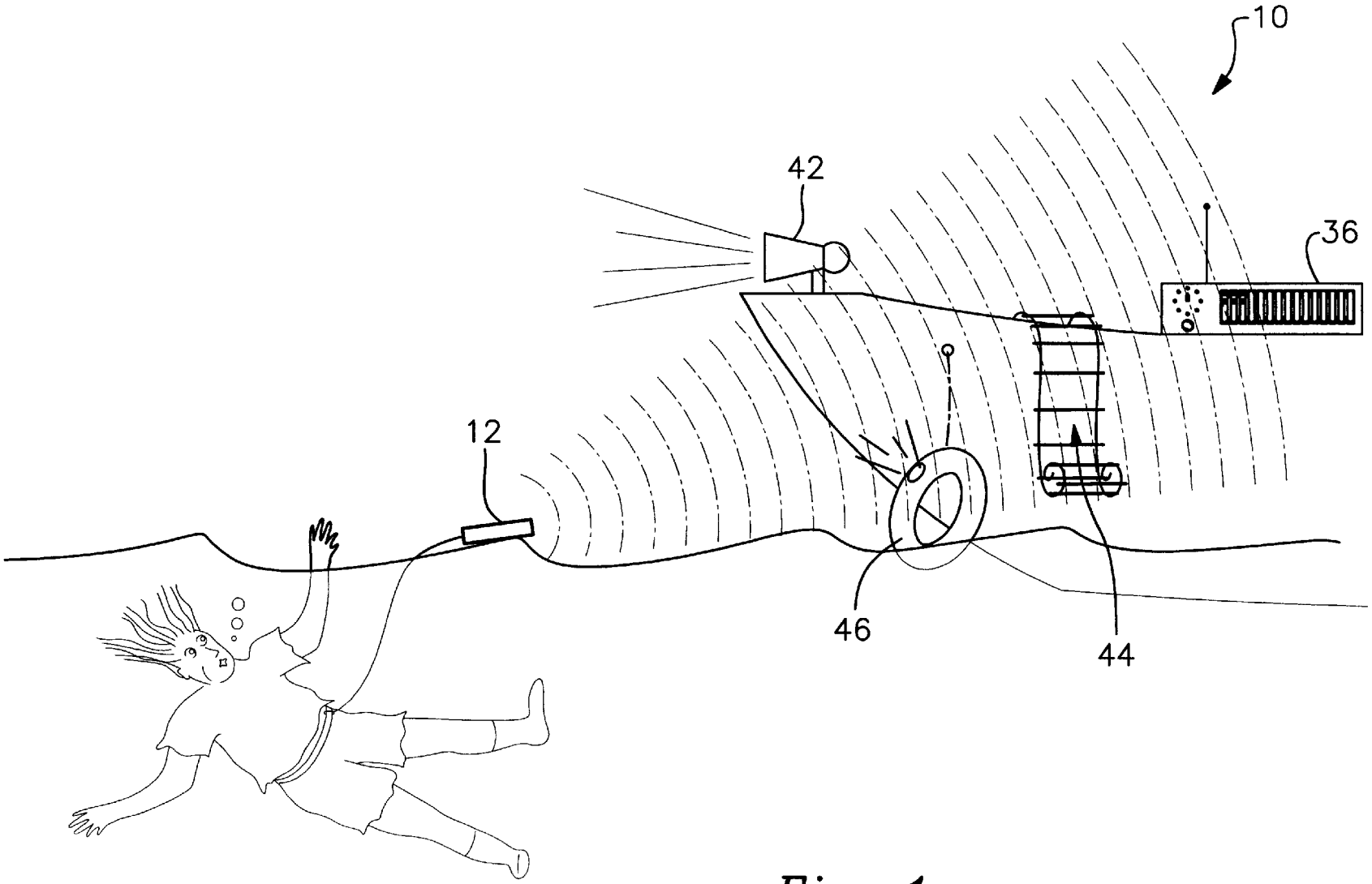
FIG. 1 is a perspective view of a new rescue apparatus according to the present invention.
Figure 4:
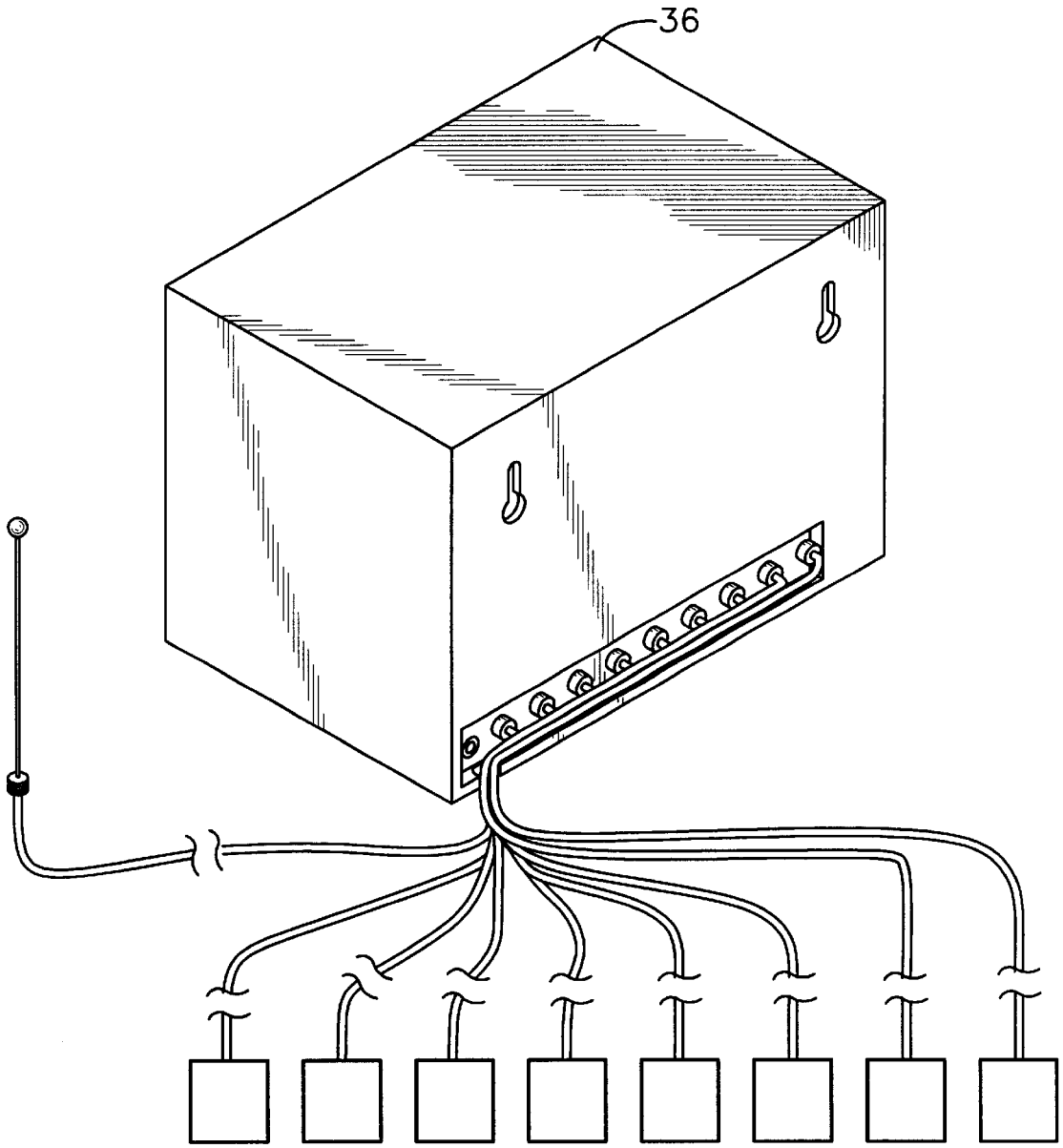
FIG. 4 is a rear perspective view of the receiver unit of the present invention.

With reference now to the drawings, and in particular to FIGS. 1 through 5B thereof, a new rescue apparatus embodying the principles and concepts of the present invention and generally designated by the reference numeral 10 will be described.

The present invention, designated as numeral 10, includes a transmitter housing 12 having a rectangular configuration. The transmitter housing includes a front face, a rear face and a thin periphery formed therebetween defining an interior space. The front face has a mirror 14 mounted thereon for distress signaling purposes. During use, the transmitter housing is adapted to float in water. To accomplish this, at least a portion of the interior space is filled with foam. Note FIG. 2A.

Also included is a flashlight assembly 16 having an illumination lamp 18 mounted on a first side face of the periphery of the transmitter housing. As shown in FIG. 2, a plurality of replaceable batteries 20 are situated within the interior space of the transmitter housing. Connected between the illumination lamp and the replaceable batteries is a manual momentary switch 22 mounted on a second side face of the periphery adjacent to the first side face of the transmitter housing. During use, the manual switch functions for allowing the selective use of the transmitter housing as a flashlight only when depressed.

Next provided is a recovery assembly 26 including a strobe light 28 mounted on the transmitter housing. The strobe light serves for emitting a high intensity intermittent light upon the actuation thereof. When the transmitter housing floats, the strobe light preferably remains atop. A transmitter 30 is mounted within the interior space of the transmitter housing for emitting an emergency signal via free space upon the actuation thereof. For actuating the strobe light and transmitter during the detection of a predetermined amount of moisture, a moisture sensor 32 is situated on the periphery of the housing.

In the preferred embodiment, the recovery assembly is powered by a rechargeable battery 33 separate from the replaceable batteries. For reasons that will become apparent hereinafter, the rechargeable battery is preferably in communication with a recharging outlet formed on a side face of the periphery of transmitter housing. As an option, light emitting diodes may be employed to indicate the current status of the batteries.

To accomplish its intended function, the transmitter housing preferably employs the circuitry of FIG. 3. As shown in such Figure, diodes are employed to ensure the proper channeling of current. Further, an SCR and a BJT are configured to detect the transmission of an activation signal from the moistures sensor and further act as a switch for allowing power to be supplied to the transmitter and strobe light. As an option, after the moisture sensor dries, the SCR may be adapted to continue to allow operation of the transmitter and strobe light.

FIG. 2 shows a coupling unit 34 including a spring loaded spool 35 positioned within the interior space of the transmitter housing. A first end of a cord is coupled to the spool. Such cord further has a second end extending from an aperture formed in the first side face of the periphery of the housing with a clip formed thereon for coupling to a user. In operation, the cord is automatically retractable. As such, upon the user falling within the water, the buoyancy of the transmitter housing forces the cord to dispense as the user sinks. Further options for the transmitter housing include a compartment for housing a manually inflatable balloon, smoke or colored fluid for attracting attention and other life saving devices.

Finally, a receiver unit 36 is provided including a receiver housing with a rear face having a pair of mounting wall apertures for mounting on a boat. Mounted on a front face of the receiver housing is a strobe 38 for emitting a high intensity intermittent light upon the receipt of the emergency via free space.

Figure 5:
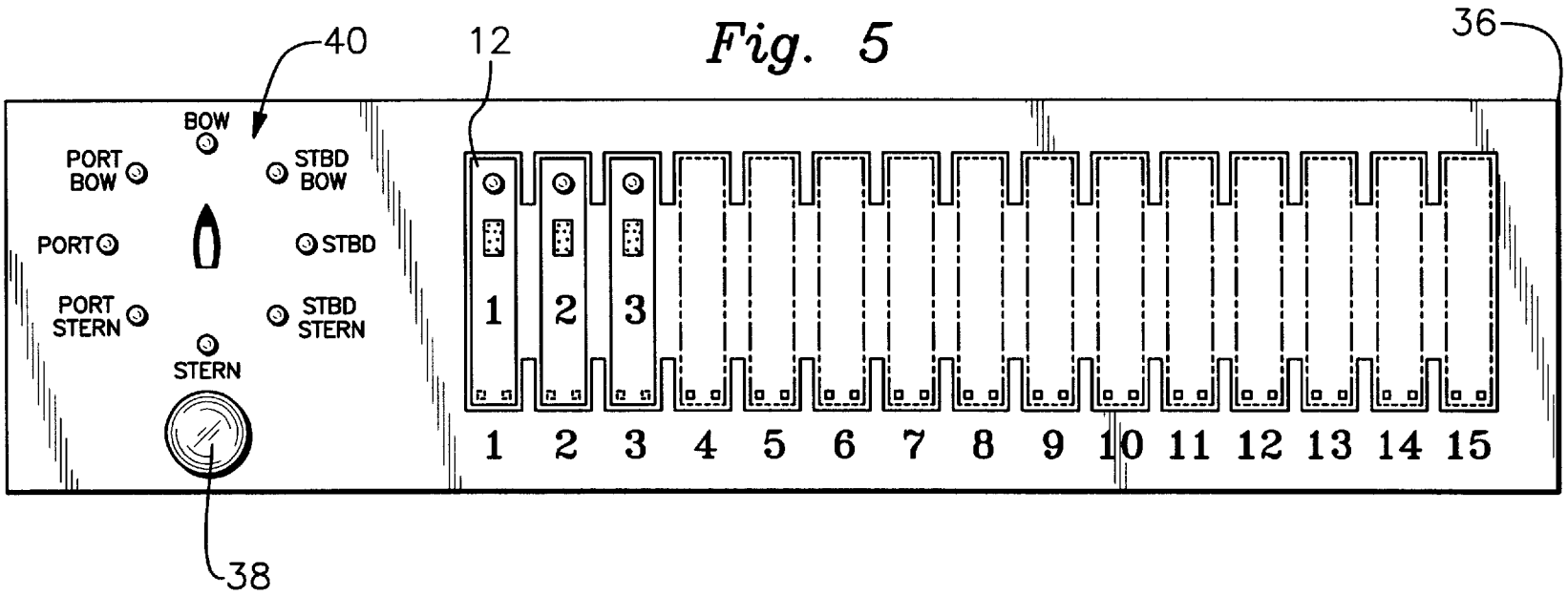
FIG. 5 is a front view of the receiver unit of the present invention.
Figure 5B:
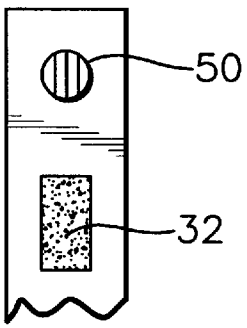
FIGS. 5A & 5B show a pair of the transmitters of the present invention.
Figure 5A:
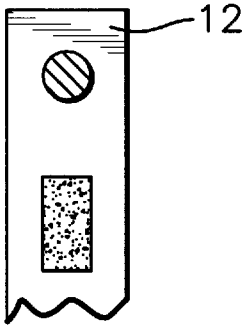

FIG. 5 depicts a direction sensor 40 including a plurality of lights mounted on the receiver housing in a circular configuration. In use, the lights of the direction sensor are adapted for indicating a direction of the transmitter housing upon the receipt of the emergency signal via free space. This is accomplished by each of the lights being associated with a specific radial direction. Indicia including "bow", "stern", "starboard" and "port" facilitate the identification of such direction. The direction indicating sensors are commonly known and commercially available. It should be noted that additional antennae may be required to afford the forgoing operation. Each of the components of the receiver unit are connected to a receiver which actuates the same when the emergency signal is received.

It should be noted that the receiver unit may be releasably connected to various life saving mechanisms aboard the boat for actuating the same upon the receipt of the emergency signal via free space. For example, the receiver unit is adapted to kill an engine of the boat and/or lower(reef) the sails on a sailboat via an optional kill switch and actuate an audio alarm 42. In addition, the receiver unit is adapted to release a ladder 44 of the boat into the water and release a life ring 46(with strobe light) of the boat into the water upon the receipt of the emergency signal via free space. In the preferred embodiment, pulleys or various release mechanisms may be used to accomplish such function. Note FIG. 1. The receiver unit may be further adapted to actuate an auxiliary strobe, autopilot cut off mechanism, a GPS unit for storing a current position or the like.

As an option, a plurality of transmitter housings may be provided, as shown in FIG. 5. Such transmitter housings may each be equipped with uniquely colored indicators 50 and further be removably situated within a corresponding slot formed in the receiver housing. When residing within the associated slot, recharging preferably occurs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rescue system comprising, in combination:

a transmitter housing having a rectangular configuration and including a front face, a rear face and a thin periphery formed therebetween defining an interior space, the front face having a mirror mounted thereon for distress signaling purposes, wherein the transmitter housing is adapted to float in water;

a flashlight assembly including an illumination lamp mounted on a first side face of the periphery of the transmitter housing, a plurality of replaceable batteries situated within the interior space of the transmitter housing, and a manual switch mounted on a second side face of the periphery adjacent to the first side face of the transmitter housing and connected between the illumination lamp and the replaceable batteries for allowing the selective use of the transmitter housing as a flashlight;

a recovery assembly including a strobe light mounted on the transmitter housing for emitting a high intensity intermittent light upon the actuation thereof, a transmitter mounted within the interior space of the transmitter housing for emitting an emergency signal via free space upon the actuation thereof, and a moisture sensor situated on the periphery of the housing and connected to the strobe light and transmitter for actuating the same during the detection of a predetermined amount of moisture;

a coupling unit including a spring loaded spool positioned within the interior space of the transmitter housing and having a first end of a cord coupled thereto, the cord having a second end extending from an aperture formed in the first side face of the periphery of the housing and having a clip formed thereon for coupling to a user, wherein the cord is automatically retractable; and a receiver unit including a receiver housing with a rear face having a pair of mounting wall apertures for mounting on a boat, a strobe light mounted on a front face of the receiver housing for emitting a high intensity intermittent light upon the receipt of the emergency via free space, and a direction sensor including a plurality of lights mounted on the receiver housing in a circular configuration for indicating a direction of the transmitter housing upon the receipt of the emergency signal via free space;

said receiver unit, upon the receipt of the emergency signal via free space, adapted to kill an engine of the boat, lower sails on a sailboat, release a ladder of the boat into the water, release a life ring of the boat into the water, and actuate an audio alarm.

2. A rescue system comprising:

a transmitter housing;

a recovery assembly including a transmitter situated within an interior space of the transmitter housing for emitting an emergency signal via free space upon the actuation thereof and a moisture sensor situated on the transmitter housing and connected to the transmitter for actuating the same during the detection of a predetermined amount of moisture; and a receiver unit including a direction sensor for indicating a direction of the transmitter housing upon the receipt of the emergency signal via free spaces;

wherein upon the receipt of the emergency signal via free space, the receiver unit is adapted to kill an engine of the boat and/or lower sails on a sailboat;

wherein the transmitter housing is adapted to float and is coupled to a user; and a flashlight assembly having an illumination lamp mounted on the transmitter housing.

3. A rescue system as set forth in claim 2 wherein the receiver unit is mounted on a boat.

4. A rescue system as set forth in claim 2 wherein the receiver unit includes a strobe light for emitting a high intensity intermittent light upon the receipt of the emergency via free space.

5. A rescue system as set forth in claim 2 wherein the direction sensor of the receiver unit includes a plurality of lights mounted on the receiver unit in a circular configuration.

6. A rescue system as set forth in claim 2 wherein upon the receipt of the emergency signal via free space, the receiver unit is adapted to release a ladder of the boat into the water.

7. A rescue system as set forth in claim 2 wherein upon the receipt of the emergency signal via free space, the receiver unit is adapted to release a life ring of the boat into the water.

8. A rescue system as set forth in claim 2 wherein upon the receipt of the emergency signal via free space, the receiver unit is adapted to actuate an audio alarm.

9. A rescue system as set forth in claim 2 wherein the transmitter housing is connected to the user via a retractable cord.

10. A rescue system as set forth in claim 2 wherein further included is a plurality of replaceable batteries situated within the interior space of the transmitter housing, and a manual switch mounted on the transmitter housing and connected between the illumination lamp and the replaceable batteries for allowing the selective use of the transmitter housing as a flashlight.

11. A rescue system as set forth in claim 2 wherein a mirror is mounted on the transmitter housing for distress signaling purposes.

12. A rescue system comprising:

a transmitter housing;

a recovery assembly including a transmitter situated within an interior space of the transmitter housing for emitting an emergency signal via free space upon the actuation thereof and a moisture sensor situated on the transmitter housing and connected to the transmitter for actuating the same during the detection of a predetermined amount of moisture; and a receiver unit including a direction sensor for indicating a direction of the transmitter housing upon the receipt of the emergency signal via free spaces;

wherein upon the receipt of the emergency signal via free space, the receiver unit is adapted to kill an engine of the boat and/or lower sails on a sailboat; and wherein the transmitter housing is adapted to float and is coupled to a user.

* * * * *